United States Patent [19]

Shimizu

[11] Patent Number: 5,050,719

[45] Date of Patent: Sep. 24, 1991

[54] COIN RECEIVING APPARATUS FOR A VENDING MACHINE

[75] Inventor: Kazuo Shimizu, Isesaki, Japan

[73] Assignee: Sanden Corporation, Gunma, Japan

[21] Appl. No.: 450,750

[22] Filed: Dec. 14, 1989

[30] Foreign Application Priority Data

Dec. 14, 1988 [JP] Japan ..... 63-315895

[51] Int. Cl.[5] ..... G07F 3/02

[52] U.S. Cl. ..... 194/202; 194/318

[58] Field of Search ..... 194/200, 202, 203, 317, 194/318, 319

[56] References Cited

U.S. PATENT DOCUMENTS 4,228,811 10/1980 Tanaka et al. ..... 194/317 X 4,625,851 12/1986 Johnson et al. ..... 194/317 X

*Primary Examiner*—F. J. Bartuska

*Attorney, Agent, or Firm*—Banner, Birch McKie & Beckett

[57] ABSTRACT

A coin receiving apparatus for a vending machine is disclosed which has a coin detector for producing an output corresponding to the diameter of a deposited coin. One or more additional coin detectors of a differential transformer type are sequentially arranged adjacent to the coin diameter detector in the coin detection path for producing an output corresponding to coin characteristics other than the coin diameter. A coin determination circuit judges whether the deposited coin is true or false in response to the detected outputs from the respective coin detectors. A coin receipt control circuit responsive to the true or false judgement output from the coin determination circuit controls the receipt or return of the deposited coin. The deposited coin is received in the receiving apparatus if the detected outputs from all of the coin detectors indicate that the deposited coin is true. A successive deposit determination circuit judges whether the last deposited coin passes through an initial coin detector on the coin detection path before the preceding deposited coin passes through a final coin detector. A timer starts to operate when the deposited coin passes through the final coin detector and responsive to an output of the successive deposit determination circuit. A determination output control circuit applies the true judgement output from the coin determination circuit to the coin receipt control circuit only when the timer does not operate after the deposited coin passes through the final coin detector. The coin receiving apparatus having such a successive deposit determination circuit, timer and determination output control circuit reduces the coin return ratio.

10 Claims, 5 Drawing Sheets

COIN RECEIVING APPARATUS FOR A VENDING MACHINE

BACKGROUND OF THE INVENTION

1. Technical Field

The present invention relates generally to the field of vending machine apparatus and, more particularly, to coin receiving apparatus for vending machines which reduces the coin return ratio.

2. Description of the Relevant Art

Conventional coin receiving apparatus for a vending machine is known, for example, from U.S. Pat. No. 4,108,296 incorporated herein by reference as to any undisclosed features or applications of the present invention. In the disclosed apparatus, three coin detectors are arranged in sequence in a coin detection path from a coin chute permitting entry of acceptable and possibly unacceptable coins. Whenever a successively deposited coin passes through an initial coin detector, a control device in the coin receiving apparatus inhibits the operation of a detection control device for a predetermined period of time. The detection control device is normally for judging whether the first deposited coin is true or false in response to the detected outputs from the respective coin detectors. If two coins are deposited in rapid succession, the control device then stops the operation of a solenoid indicating the first coin is acceptable and then controls the rejection of the coin even if it is acceptable. Thus, the only reason for the rejection of the coin is that the coin was deposited too quickly and so too closely followed the preceding coin in the coin detection path. The rejection of the control device is controlled by a timer whose operation is defined by the length of time required for a coin to pass through the length of the coin detection path.

The operation time of the timer begins when the deposited coin passes through the initial coin detector. As coins are successively deposited during the operation time of the timer, the timer is reset. The timer begins again as each successively deposited coin passes by the initial coin detector. Accordingly, as each coin is successively deposited, any rejection controlled by the control device is resolved by the operation time of the timer concerning the last deposited coin. If the operation time has lapsed, the next deposited coin has an opportunity to not be rejected, but if the operation time has not lapsed, the coin will be rejected even if it is acceptable and just because it was deposited too quickly.

In other words, since the control device causes a coin rejection continuously for successively deposited coins until the last deposited coin is returned to the user of the vending machine, all deposited coins may be returned to the user if the user deposits the coins too quickly. The operation of the vending machine then becomes inconvenient to the user who may choose not to use the machine.

SUMMARY OF THE INVENTION

It is a primary object of the present invention to provide a coin receiving apparatus for a vending machine which can reduce the coin return ratio.

A coin receiving apparatus for a vending machine according to the present invention has a coin detector for producing an output corresponding to the diameter of a deposited coin. The coin detector includes a coil arranged so that the magnetic flux thereof is substantially perpendicular to the plane of a deposited coin and so crosses its diameter as the coin passes through a coin detection path. Also, one or more additional coin detectors are provided of a differential transformer type. These are sequentially arranged adjacent to the coin diameter detector in the coin detection path for producing an output corresponding to coin characteristics other than the coin diameter. A coin determination circuit judges whether the deposited coin is true or false in response to the detected outputs from the respective coin detectors. A coin receipt control circuit responsive to the true or false judgement output from the determination circuit controls the receipt or return of the deposited coin. The deposited coin is received in the receiving apparatus if the detected outputs from all of the coin detectors indicate that the deposited coin is true.

The present invention relates particularly to a particular arrangement of a successive deposit determination circuit, a timer, and a determination output control circuit which may decrease the coin return ratio in comparison with the prior art. A successive deposit determination circuit responsive to an initially placed coin detector and a final coin detector in the coin detection path judges whether the last deposited coin has passed through the initial coin detector before the preceding coin has passed through the final coin detector. A timer according to the present invention starts to operate after the deposited coin passes through the final coin detector and after the successive deposit determination circuit has output a judgment. The determination output control circuit of the invention applies the true judgement output from the coin determination circuit to a coin receipt control circuit only when the timer fails to operate and after the deposited coin passes through the final coin detector. Thus, according to the present invention, the operation is more closely controlled by detecting the event of a coin passing a final detector in comparison with the prior art which estimates the time of the event.

Further objects, features and other aspects of this invention will be understood from the following detailed description of the preferred embodiments to this invention with reference to the drawings.

DETAILED DESCRIPTION OF THE PREFERRED EMBODIMENTS

Figure 1:
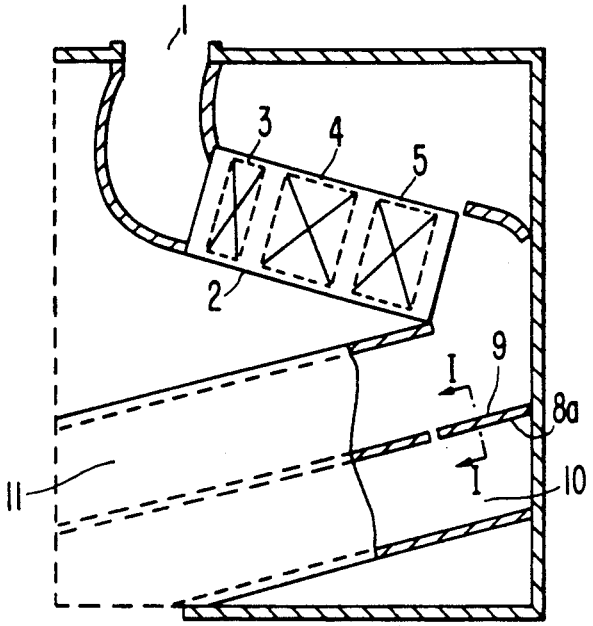
FIG. 1 is a schematic view of a part of a mechanical portion of a coin receiving apparatus according to this invention.
Figure 2:
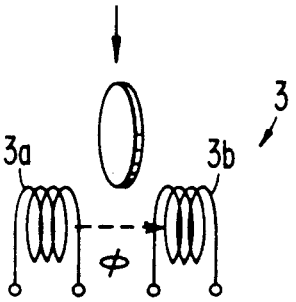
FIG. 2 shows the primary and secondary windings of a coin detector for detecting the diameter of a coin.

Referring first to FIG. 1, a coin deposited from insertion slot 1 is introduced into coin detection path 2. Three coin detectors 3, 4 and 5 are sequentially arranged in coin detection path 2. Coin detector 3 of the initial stage of the path 2 is constructed to detect the diameter of the deposited coin and has a primary winding coil 3*a* and a secondary winding coil 3*b*, as shown in FIG. 2. In FIG. 2, these winding coils 3*a* and 3*b* are so arranged that magnetic flux is substantially perpendicular to the plane of a deposited coin and crosses the diameter of a coin falling in the coin detection path 2. Accordingly, the larger the diameter of the coin is, the more the magnetic flux is crossed by the coin. Thus, coin detector 3 produces a detected waveshape having a peak value (negative value in this case) corresponding to the diameter of the coin from the secondary winding coil 3*b*.

Coil detectors 4 and 5 of the following stages of the path 2 employ a coin detector of the differential transformer type and are constructed to detect respectively different characteristics of the coin deposited in the apparatus from the diameter. For example, coin detector 4 is constructed to detect the material of the deposited coin, while the other coin detector 5 is constructed to detect the surface incuse pattern and shape of the deposited coin. These coil detectors 4 and 5 have similar winding coils (not shown) as coil detector 3 to detect the above characteristics.

Figure 3:
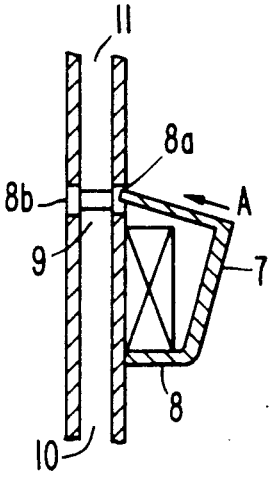
FIG. 3 is a cross-sectional view taken along line I—I as shown in FIG. 1.
Figure 4:
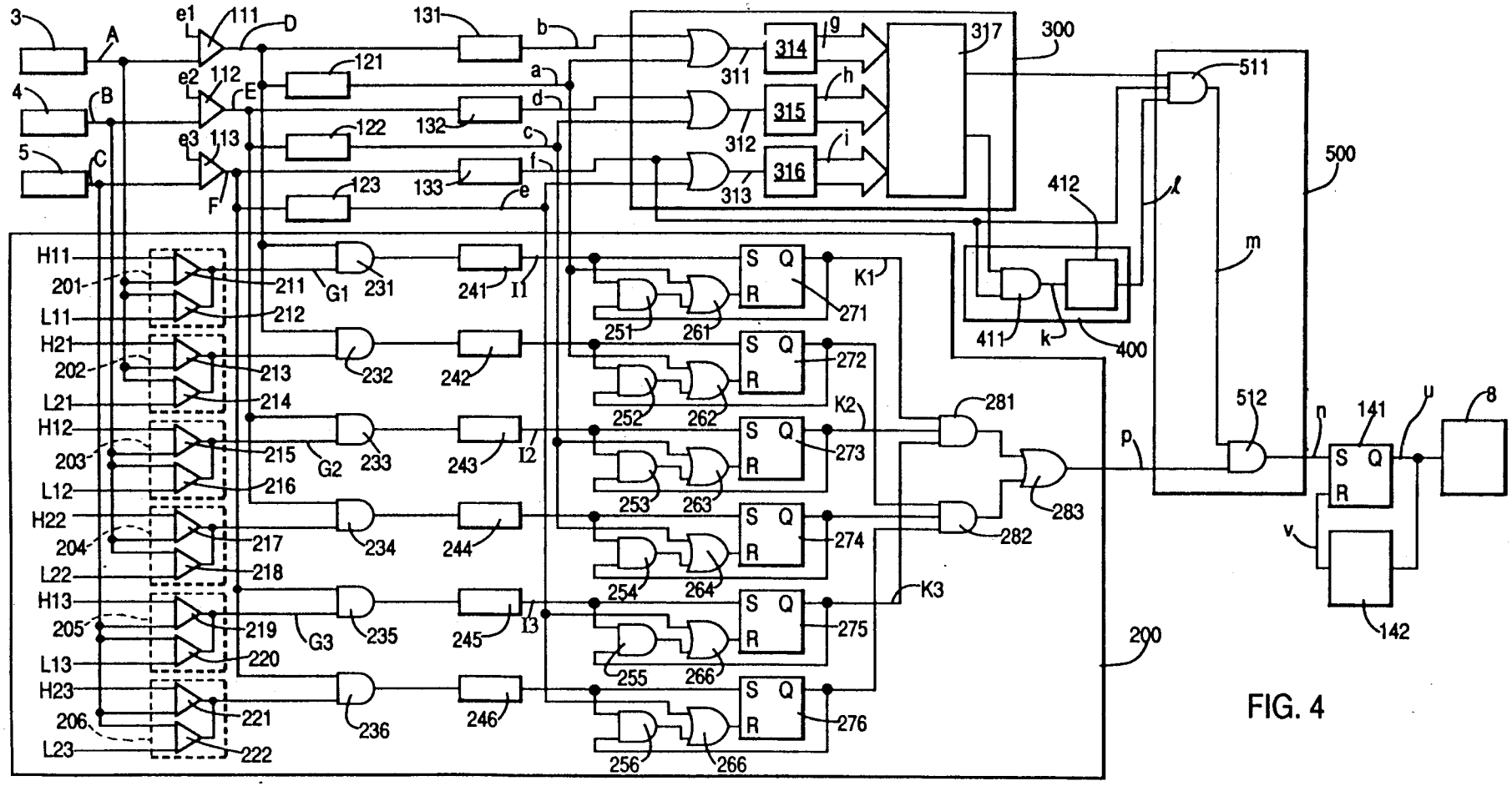
FIG. 4 is a block diagram of a circuit portion of the embodiment of the coin receiving apparatus as shown in FIG. 1.

Referring now to FIG. 3, when the deposited coin has passed through coin detector 5 of the final stage, a judgement as to whether the deposited coin is true or false is completed. If the deposited coin has been judged true, acceptable solenoid 6 as is shown in FIG. 4 is energized, and coin receiving projection 7 is pulled in coin detection path 2 through elongated holes 8*a* and 8*b* as designated by an arrow A. Opening 9 formed in the lower portion of the end of the path 2 is normally opened toward return path 10 and is closed by projection 7 when solenoid 6 is energized by the detection of the true coin. Therefore, the deposited coin delivered from coin detection path 2 is introduced into true coin path 11 only when solenoid 6 is energized. Otherwise, the deposited coin is introduced into return path 10 located at the lower side of the path 11 via opening 9 and then to a return port (not shown).

Referring to FIG. 4, a block diagram of a circuit portion in accordance with one embodiment of this invention is shown.

The circuit portion comprises coin detectors 3, 4 and 5, at the upper left acceptable solenoid 6 at the bottom right, comparators 111–113, first pulse generators 121–123, second pulse generators 131–133, coin determination circuit 200, successive deposit determination circuit 300, timer circuit 400 and determination signal control circuit 500.

Output A, B and C produced from coin detectors 3–5 are applied to corresponding comparators 111–113, respectively, and determination circuit 200. Comparator 111 compares output A with reference voltage e1 and generates output "1" i.e., D when the voltage of output A is equal to low reference voltage e1. Otherwise, comparator 111 generates output "0" i.e., D. Comparator 112 compares output B with reference voltage e2 and generates output "1" E when the voltage of output B is equal to reference voltage e2. Otherwise, comparator 112 generates output "0", i.e. E at low level. Comparator 113 compared output C with reference voltage e3 and generates output "1" is they are equal, i.e., F. Otherwise, comparator 113 generates output "0", i.e., F.

Output signal D produced from comparator 111 is applied to the input terminals of first and second pulse generators 121 and 131, and coin determination circuit 200. Output signal E produced from comparator 112 is applied to the input terminals of first and second pulse generators 122 and 132, and coin determination circuit 200. Output signal F produced from comparator 113 is applied to the input terminals of first and second pulse generators 123 and 133, and coin determination circuit 200. First pulse generators 121, 122 and 123 detect outputs D, E, and F from comparators 111, 112 and 113 and apply outputs "1", i.e., a, c, and e to determination circuit 200 and continuous deposit determination circuit 300, respectively, when outputs D, E and F change from output "0" to output "1". Second pulse generators 131, 132 and 133 detect outputs D, E and F from comparators 111, 112 and 113 and apply outputs "1" b, d and f to successive deposit determination circuit 300, respectively, when outputs D, E and F change from output "1" to output "0".

Determination circuit 200 comprises window circuits 201–206, first AND gates 231–236 with two input terminals, respectively, third pulse generators 241–246, second AND gates 251–256 with two input terminals, respectively, first OR gates 261–266 with two input terminals, respectively, RS flip-flops 271–276, third AND gates 281 and 282 with three input terminals, respectively and second OR gates 283. Window comparators 201–206 include comparators 211 and 212, 213 and 214, 215 and 216, 217 and 218, 219 and 220, and 221 and 222, respectively, of which the respective output terminals are connected to each other, and form the output terminal of window comparators 201–206.

Output A produced from coin detector 3 is applied to comparators 211, 212, 213 and 214. Comparator 211 compares the voltage of output A with reference voltages H 11, and produces output "1" when the voltage of output A is below reference voltage H 11. Otherwise, comparator 211 produces output "0". Comparator 212 compares the voltage of output A with reference voltage L 11, and produces output "1" when the voltage of output A is greater than and equal to reference voltage L 11. Otherwise, comparator 212 produces output "0".

Since reference voltage H 11 is set to be greater than reference voltage L 11, when the voltage of output A is greater than or equal to reference voltage L 11 and is below reference voltage H 11, comparators 211 and 212 produces output "1", thereby window circuit 201 applies "1" to one input terminal of first AND gate 231. Contrarily, when the voltage of output A is less than reference voltage L 11 or is greater than reference voltage H 11, the outputs from comparators 211 and 212 are a combination of output "0" and output "1". Accordingly, the outputs from comparators 211 and 212 are different each other, respectively, thereby window circuit 201 applies output "0" to one input terminal of first AND gate 231.

Comparator 213 compares the voltage of output A with reference voltage H 21 and produces an output "1" when the voltage of output A is below reference voltage H 21. Otherwise, comparator 213 produces output "0". Comparator 214 compares the voltage of output A with reference voltage L 21, and produces output "1"

when the voltage of output signal A is greater than or equal to reference voltage L 21. Otherwise, comparator 214 produces output "0". Since reference voltage H 21 is set to be greater than reference voltage L 21, when the voltage of output A is greater than or equal to reference voltage L 21 and is below reference voltage H 21, comparators 213 and 214 produce output "1", thereby window circuit 202 applies output "0" to one input terminal of first AND gate 232. Contrarily, when the voltage of output A is less than reference voltage L 21 or is greater than reference voltage H 21, the outputs produced from comparators 213 and 214 are a combination of output "0" and output "1". Accordingly, the outputs from comparators 213 and 214 are different from each other, respectively, thereby window circuit 202 applies output "0" to one input terminal of first AND gate 232.

Output B from coin detector 4 is applied to comparators 215, 216, 217 and 218. Comparator 215 compares the voltage of output B with reference voltages H 12 and produces output "1" when the voltage of output B is below reference voltage H 121. Otherwise, comparator 215 produces output "0". Comparator 216 compares the voltage of output B with reference voltages L 12 and produces output "1" when the voltage of output B is greater than or equal to reference voltage L 12. Otherwise, comparator 216 produces output "0". Since reference voltage H 12 is set to be greater than reference voltage L 12, when the voltage of output B is greater than or equal to reference voltage L 12 and is below reference voltage H 12, comparators 215 and 216 produce output "1", thereby window circuit 203 applies output "1" to one input terminal of first AND gate 233. Contrarily, when the voltage of output B is less than reference voltage L 12 or is greater than reference voltage H 12, the outputs from comparators 215 and 216 are output "0" and output "1". Accordingly, the output signals from comparators 215 and 216 are different each other, respectively, thereby window circuit 203 applies output "0" to one input terminal of first AND gate 233.

Comparator 217 compares the voltage of output B with reference voltage H 22 and produces output "1" when the voltage of output B is below reference voltage H 22. Otherwise, comparator 217 produces output "0". Comparator 218 compares the voltage of output B with reference voltage L 22 and produces output "1" when the voltage of output B is greater than or equal to reference voltage L 22. Otherwise, comparator 218 produces output "0". Since reference voltage H 22 is set to be greater than reference voltage L 22, when the voltage of output B is greater than or equal to reference voltage L 22 and is below reference voltage H 22, comparators 217 and 218 produce output "1", thereby window circuit 204 applies output "1" to one input "1", thereby window circuit 204 applies output "1" to one input terminal of first AND gate 234. Contrarily, when the voltage of output B is less than reference voltage L 22 or is greater than reference voltage H 22, the outputs from comparators 217 and 218 are a combination of output "0" and output "1". Accordingly, the output from comparators 217 and 218 are different each other, respectively, thereby window circuit 204 applies output "0" to one input terminal of first AND gate 234.

Output C from coin detector 5 is applied to comparators 219, 220, 221 and 222. Comparator 219 compares the voltage of output C with reference voltages H 13 and produces output "1" when the voltage of output C is below reference voltages H 13. Otherwise, comparator 219 produces output "0". Comparator 220 compares the voltage of output C with reference voltages L 13 and produces output "1" when the voltage of output C is greater than or equal to reference voltage L 13. Otherwise, comparator 220 produces output "0". Since reference voltage H 13 is set to be greater than reference voltage L 13, when the voltage of output C is greater than or equal to reference voltage L 13 and is below reference voltage H 13, comparators 219 and 220 produce output "1", thereby window circuit 205 applies output "1" to one input terminal of first AND gate 235. Contrarily, when the voltage of output C is less than reference voltage L 13 or is greater than reference voltage H 13, the outputs from comparators 219 and 220 are a combination of output "0" and output "1". Accordingly, the outputs from comparators 219 and 220 are different each other, respectively, thereby window circuit 205 applies output "0" to one input terminal of first AND gate 235.

Comparator 221 compares the voltage of output C with reference voltage H 23 and produces output "1" when the voltage of output C is below reference voltage H 23. Otherwise, comparator 221 produces output "0". Comparator 222 compares the voltage of output C with reference voltage L 23 and produces output "1" when the voltage of output C is greater than or equal to reference voltage L 23. Otherwise, comparator 222 produces output "0". Since reference voltage H 23 is set to be greater than reference voltage L 23, when the voltage of output C is greater than or equal to reference voltage L 23 and is below reference voltage H 23, comparators 221 and 222 produce output "1", thereby window circuit 206 applies output "1" to one input terminal of first AND gate 236. Contrarily, when the voltage of output C is less than reference voltage L 23 or is greater than reference voltage H 23, the outputs from comparators 221 and 222 are a combination of output "0" and output "1". Accordingly, the outputs from comparators 221 and 222 are different each other, respectively, thereby window circuit 206 applies output "0" to one input terminal of first AND gate 236.

Window circuits 201, 203 and 205 are constructed to detect the peak level of a 10 yen coin detection waveshape. Japanese coins are described herein but the principles of the present invention may be adapted for the coin of any issuing authority including transportation authorities or other non-governmental institutions. Reference voltages H 11–H 13, respectively, applied to the inputs of comparators 211, 215 and 219 are to set the upper limit value of the peak level of the 10 yen coin detection waveshape, while reference voltages L 11–L 13, respectively, applied to the inputs of comparators 212, 216 and 220 are to set the lower limit value of the peak level of the 10 yen coin detection waveshape. In the meanwhile, window circuits 202, 204 and 206 are constructed to detect the peak level of a 50 yen coin detection waveshape. Reference voltages H 21–H 23, respectively, applied to the inputs of comparators 213, 217 and 221 are to set the upper limit value of the peak level of the 50 yen coin detection waveshape, while reference voltages L 21–L 23, respectively, applied to the inputs of comparators 214, 218 and 222 are to set the lower limit value of the peak level of the 50 yen coin detection waveshape.

Output D from comparator 111 is applied to the other input terminals of first AND gate 231 and 232. Output E from comparator 112 is applied to the other input terminals of first AND gates 233 and 234. Output F from comparator 113 is applied to the other input terminals of first AND gates 235 and 236. The outputs from first AND gates 231-236 are applied to corresponding respective third pulse generators 241-246. Third pulse generators 241-246 detect the output from the first AND gates 231-236 and produce output "1" when the output from first AND gates 231-236 change from output "0" output "1".

The outputs from third pulse generators 241-246 are applied to input terminals S of RS flip-flops 271-276 and one input terminal of second AND gates 251-256, respectively. The outputs from output terminals Q of RS flip-flops 271, 273 and 275 are applied to the input terminals of third AND gate 281. The outputs from output terminals Q of RS flip-flops 273, 273 and 275 are also applied to the other input terminals of second AND gates 251, 253 and 255. The outputs from output terminals Q of flip-flops 272, 274 and 276 are applied to the input terminals of third AND circuit 282. The outputs from output terminals Q of RS flip-flop 273, 274 and 276 are also applied to the other input terminal of second AND gates 252, 254 and 256.

The outputs from second AND gates 251-256 are applied to corresponding one input terminals of first OR gates 261-266. Output a from first pulse generator 121 is applied to the other input terminals of first OR gates 261 and 262. Output c from first pulse generator 122 is applied to the other input terminals of first OR gates 263 and 264. Output e from first pulse 123 is applied to the other input terminals of first OR gates 265 and 266. The output signals from first OR gates 261-266 are applied to reset terminals R of corresponding RS flip-flops 271-276, respectively. The output from third AND gate 281 is applied to one input terminal of second OR gate 283 and the output from third AND gate 282 is input to the other input terminal of second OR gate 283.

Successive deposit determination circuit 300 comprises third OR gates 311-313 with two input terminals, respectively, ring counters 314-316, and digital comparator 317.

Ring counters 314-316 count when ring counters 314-316 receive output "1" from third OR gate 311-313, respectively. Otherwise, ring counters 314-316 do not count. If ring counters 314-316 count over, ring counters 314-316 are reset, and start to count again. Output data g, h and i from ring counters 314-316 are applied to digital comparator 317. Digital comparator 317 compares output data g, h and i with each other. Digital comparator 317 produces output "1" from output terminal DI and "0" from output terminal DII when all output data g, h and I are completely equal. Otherwise, digital comparator 317 produce output "1" from output terminal DII and output "0" from output terminal DI.

Output a from first pulse generator 121 is applied to one input terminal of third OR gate 311 and output b from second pulse generator 131 is applied to the other input terminal of third OR gate 311. Output c from first pulse generator 122 is applied to one input terminal of third OR gate 312 and output d from second pulse generator 132 is applied to the other input terminal of third OR gate 312. Output e from first pulse generator 123 is applied to one input terminal of third OR gate 313 and output f from second pulse generator 133 is applied to the other input terminal of third OR gate 313. The outputs from third OR comparators 311-313 are applied to respective corresponding clock signal input terminals of ring counters 314-316. Outputs g, h and i from ring counters 314-316 are applied to three input terminals of digital comparator 317.

Timer circuit 400 comprises fourth AND gate 411 and timer 412. Timer 412 always produces output "1" and produces output "0" for predetermined time TM only when the output from fourth AND gate 411 to timer 412 changes into output "1" from output "0". Predetermined timer TM is set according to the length of time for a deposited coin to pass through final coin detector 5 and reach coin receipt inlet 9.

Output f from second pulse generator 133 is applied to one input terminal of fourth AND gate 411 and the output from output terminal DII of digital comparator 317 is applied to the other input terminal of fourth AND gate 411. The output from fourth AND gate 411 is applied to timer 412.

Determination signal control circuit 500 comprises fifth AND gate 511 with three input terminals and sixth AND gate 512 with two input terminals. The output from output terminal DI of digital comparator 317 is applied to one input terminal of fifth AND gate 511. Output f from second pulse generator 133 is applied at another input terminal of fifth AND gate 511. Output 1 from timer 412 is applied to the other input terminal of fifth AND gate 511. Output p from second OR gate 283 is applied to one input terminal of sixth AND gate 512 and output m from fifth AND gate 511 is applied to the other input terminal of sixth AND gate 512. Output n from sixth AND gate 512 is applied to set terminal S of RS flip-flop 141. The output from output terminal Q of RS flip-flop 141 is applied to acceptable solenoid 6 and its reset terminal R through delay circuit 142. Delay circuit 142 delays the operation of RS flip-flop 141 from appling the output from its output terminal Q to reset terminal R for predetermined time DM which as already described is the length of time for a coin to pass through final coin detector 5 and reach opening 9. Acceptable solenoid 6 is energized when output u from output terminal Q of RS flip-flop 141 is output "0".

Figure 5:
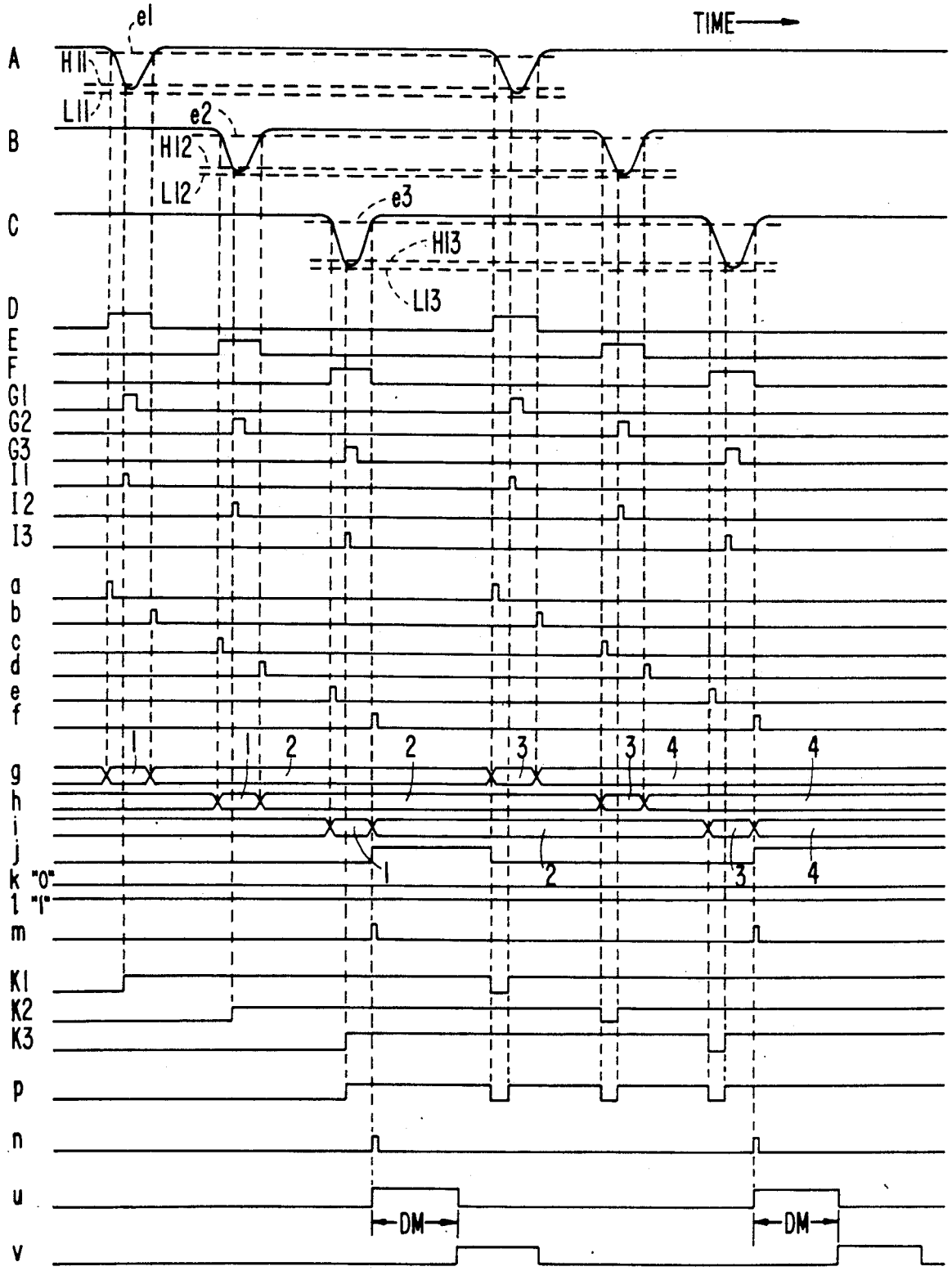
FIG. 5 is a timing chart showing waveforms of outputs from respective portions of the circuit as shown in FIG. 4 in the event true coins are not successively deposited.

The operation of a coin receiving apparatus in accordance with one embodiment of this invention is described below. With reference to the block diagram of FIG. 4 and a timing chart as shown in FIG. 5, the operation of the coin receiving apparatus in the event two true 10 yen coins are deposited in coin detection path 2, but not successively deposited, is described.

When a 10 yen coin deposited from slot 1 passes through coin detectors 3, 4 and 5, coin detectors 3, 4 and 5 produce outputs A, B and C, which are the detection waveshapes, corresponding to the coin, respectively. Outputs A, B and C produced from coin detectors 3, 4 and 5 are applied to comparators 111-113, respectively, and compared with reference voltages e1, e2 and e3 therein, thereby comparators 111-113 apply outputs "1", i.e., D, E and F to one terminal of first AND gates 231, 233 and 235 when outputs A, B and C are below reference voltages e1, e2 and e3, respectively. Likewise, outputs A, B and C are applied to window circuits 201, 203 and 205, each of which comprises comparators circuits 211 and 212, 215 and 216, and 219 and 220, respectively, and peak levels of the 10 yen coin detection waveshape of outputs A, B and C are respectively compared with reference voltages H 11 and L 11, H 12 and L 12, and H 13 and L 13 at comparators 211 and 212, 215 and 216, and 219 and 220. The upper limit reference voltages H 11, H 12 and H 13 applied to comparators 211, 215 and 219 are to set the upper limit value of the 10 yen coin detection waveshape, while the lower limit reference voltages L 11, L 12 and L 13 applied to comparators 212, 216 and 220 are set to the lower limit value of the 10 yen coin detection waveshape. Since these upper and lower reference voltages are set so that the peak levels of the detection waveshape is between the respective corresponding reference voltages when the deposited coin is true, window circuits 201, 203 and 205 respectively apply outputs "1", i.e., G1, G2 and G3 to the other input terminal of first AND gates 231, 233 and 235. First AND gates 231, 233 and 235 compare outputs "1" from comparators 111-113 with outputs "1" from window circuits 201, 203 and 205, and apply output "1" to the inputs of third pulse generators 241, 243 and 245, respectively. Third pulse generators 241, 243 and 245 produce outputs "1", i.e., I1, I2 and I3, respectively.

Outputs D, E and F produced from comparators 111-113 are also applied to first and second sets of generators 121-123, and 131-133, respectively. First pulse generators 121-123 detect the rise of outputs D, E and F, and produce outputs "1", i.e., a, c and e, while second pulse generators 131-133 detect the drop of outputs D, E and F, and produce outputs "1", i.e., b, d and f. Outputs a, c and e, and b, d and f are respectively applied to third OR gates 311-313, and third OR gates 311-313 produce outputs "1". Accordingly, ring counter 314 counts according to outputs a and b, and produces output data g. Ring counter 315 counts according to outputs c and d, and produces output data h. Ring counter 316 counts according to outputs e and f, and produces output data i. Since the coins are not deposited successively, outputs g, h and i produced from ring counters 314-316 are equal to each other after the deposited coin passes through coin detector 5, i.e., coin detector 5 produces output C. Thus, digital comparator 317 applies output "1", i.e., J, from output terminal DI to one input terminal of first AND gate 511, while digital comparator 317 applies output "0" from output terminal DII to one terminal of input fourth AND gate 411. Accordingly, fourth AND gate 411 produces output "0", i.e., k, and timer 412 does not start to operate, thereby output "1" produced from timer 412 is applied to one input terminal of fifth AND gate 511. Since outputs f and j produced from second oscillator 133 and output terminal DI of digital comparator 317 are applied to the other input terminals of fifth AND gate 511, output "1", i.e., m from fifth AND gate 511 is applied to one input terminal of sixth AND gate 512.

Output "1", i.e., a produced from first pulse oscillator 121 is applied to first OR gate 261, and first OR gate 261 applies output "1" to reset terminal R of RS flip-flop 271. RS flip-flop 271 applies output "0", i.e., K1 from output terminal Q to one input terminal of third AND gate 281 and thereafter is set by output "1", i.e., I1 from third pulse oscillator 241 to its set terminal S. Output "1", i.e., c produced from first pulse generator 122 is applied to first OR gate 263, and first OR gate 263 applies output "1" to reset terminal R of RS flip-flop 273. RS flip-flop 273 applies output "0", i.e., K2 from output terminal Q to another input terminal of third AND gate 281 and thereafter is set by output "1", i.e., I2 from third pulse generator 243 to its set terminal S. Output "1", i.e., e produced from first pulse generator 123 is applied to first OR gate 265, and first OR gate 265 applies output "1" to reset terminal R of RS flip-flop 275. RS flip-flop 275 apply output "0", i.e., K3 from output terminal Q to the other input terminal of third AND gate 281 and thereafter is set by output "1", i.e., I3 from third pulse oscillator 245 to its set terminal S.

As mentioned above, when the deposited coin is true, outputs "1", i.e., K1, K2 and K3 produced from RS flip-flop 271, 273 and 275 respectively are applied to respective input terminals of third AND gate 281, output "1" from third AND gate 281 is applied to one input terminal of second OR gate 283, thereby output "1", i.e., p produced from second OR gate 283 is applied to the other input terminal of sixth AND gate 512. Output "1", i.e., n produced from sixth AND gate 512 is applied to set terminal S of RS flip-flop 141. Thus, output "1", i.e., u from output terminal Q of RS flip-flop 141 is applied to acceptable solenoid 6 and delay circuit 142. Although output "1", i.e., v produced from delay circuit 142 is applied to reset terminal R of RS flip-flop 141, the output from delay circuit 142 is delayed for delay time TM. Delay time DM of delay circuit 142 is defined as the time duration from when the deposited coin passes through opening 9 after passing final coin detector 5. Therefore, acceptable solenoid 6 results in being energized for delay time DM.

Figure 6:
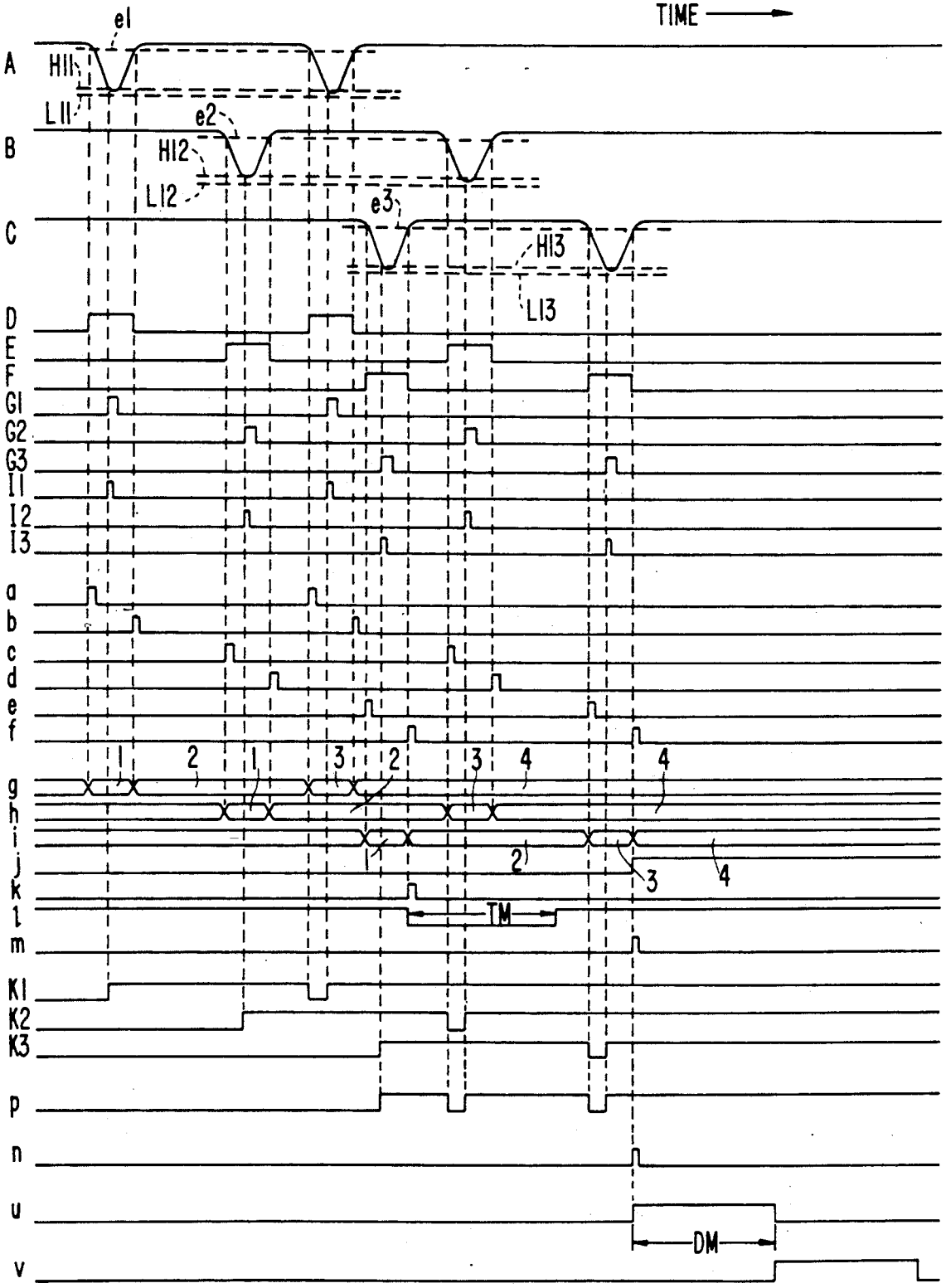
FIG. 6 is a timing chart as shown in FIG. 4 in the event true coins are successively deposited.

The operation of a coin receiving apparatus in accordance with one embodiment of this invention is described below. With reference to a timing chart as shown in FIG. 6, the operation of the coin receiving apparatus in the event two true 10 yen coins are successively deposited in coin detection path 2 without a sufficient time interval between the two coins is described.

When a 10 yen coin deposited from slot 1 passes through coin detectors 3, 4 and 5, coin detectors 3, 4 and 5 produce outputs A, B and C, which are the detection waveshapes, corresponding to the coin, respectively. Outputs A, B and C produced from coin detectors 3, 4 and 5 are applied to comparators 111-113, respectively, and compared with reference voltages e1, e2 and e3 therein, thereby comparators 111-113 apply outputs "1", i.e., D, E and F to one terminal of first AND gates 231, 233 and 235 when outputs A, B and C are below reference voltages e1, e2 and e3, respectively. Likewise, outputs A, B and C are applied to window circuits 201, 203 and 205, each of which comprises comparators 211 and 212, 215 and 216, and 219 and 220, respectively, and peak levels of the 10 yen coin detection waveshape of outputs A, B and C are respectively compared with reference voltages H 11 and L 11, H 12 and L 12, and H 13 and L 13 at comparators 211 and 212, 215 and 216, and 219 and 220. The upper limit reference voltages H 11, H 12 and H 13 applied to comparators 211, 215 and 219 are to set the upper limit value of the 10 yen coin detection waveshape, while the lower limit reference voltages L 11, L 12 and L 13 applied to comparators 212, 216 and 220 are to set the lower limit value of the 10 yen coin detection waveshape. Since these upper and lower reference voltages are set so that the peak levels of the detection waveshape between the respective corresponding reference voltages when the deposited coin is true, window circuits 201, 203 and 205 respectively apply outputs "1", i.e., G1, G2 and G3 to the other input terminal of first AND gates 231, 233 and 235. First AND gates 231, 233 and 235 compare outputs "1" from comparators 111-113 with outputs "1" from window circuits 201, 203 and 205, and apply output "1" to the inputs of third pulse generators, 241, 243 and 245, respectively. Third pulse generators 241, 243 and 245 produce outputs "1", i.e., I1, I2 and I3, respectively.

Outputs D, E and F produced from comparators 111-113 are also applied to first and second generators 121–123, and 131–133, respectively. First pulse generators 121–123 detect the rise of outputs D, E and F, and produce outputs "1", i.e., a, c and e, while second pulse generators 131–133 detect the drop of outputs D, E and F, and produce outputs "1", i.e., b, d, and f. Outputs a, c and e, and b, d and f are respectively applied to third OR gates 311–313, and third OR gates 311–313 produce outputs "1". Accordingly, ring counter 314 counts according to outputs a and b, and produces output data g. Ring counter 315 counts according to outputs c and d, and produces output data h. Ring counter 316 counts according to outputs e and f, and produces output data i. Since it is assumed that the coins are deposited successively without a sufficient time interval, outputs g, h and i produced from ring counters 314–316 are finally equal to each other after the subsequently deposited coin passes through coin detector 5, i.e., coin detector 5 produces final output C. However, since the subsequently deposited coin passes through coin detector 3 before the preceding coin passes through coin detector 5, when the preceding deposited coin passes through coin detector 5, outputs g, h and i produced from ring counters 314, 315 and 316 do not equal each other thereby successive deposit determination circuit 300 determines that there has been a continuous deposit of coins. Thus, digital comparator 317 applies output "1" from output terminal DII to one input terminal of fourth AND gate 411, while digital comparator 317 applies output "0" from output terminal DI to one input terminal of fifth AND gate 511. Accordingly, fourth AND gate 411 produces output "1", i.e., k, and timer 412 starts to operate, thereby the output produced from timer 412 is applied to one input terminal of fifth AND gate 511 is "0" for the set time TM of timer 412. Since outputs f produced from second generator 133 and the output produced from output terminal DI of digital comparator 317 are applied to the other input terminals of fifth AND gate 511, output "0", i.e., m from fifth AND gate 511 is applied to one input terminal of sixth AND gate 512. The output from sixth AND gate 512 is "0" independently of the output from second OR gate 283 to the other input terminal of sixth AND gate, thereby not energizing acceptable solenoid 6. Thus, the initially deposited coin is returned to return path 10 via opening 9.

If the subsequently deposited coin passes through the last coin detector 5 after set time TM elapsed, output "1" from output terminal DI of digital comparator 317 is applied to one input terminal of fifth AND gate 511, while output "0" from output terminal DII of digital comparator 317 is applied to one input terminal of fourth AND gate 411. Accordingly, the output from fourth AND gate 411 is "0", thereby not starting timer 412 to operate. Thus, timer 412 applies output "1" to the other input terminal of fifth AND gate 511, thereby applying output "1" from fifth AND gate 511 to one input terminal of sixth AND gate 512. Therefore, acceptable solenoid 6 is energized, and the subsequently deposited coin is introduced into true coin path 11 via opening 9.

In the situation where two coins are deposited so close together in time that the subsequently deposited coin of the two coins has passed detector 5 before the operation of timer 412 is completed, output "0" from output terminal of timer 412 cannot be changed, thereby not energizing acceptable solenoid 6. Thus, the subsequently deposited coin is also returned to return path 10.

In case two true 50 yen coins are deposited in coin detection path 2, outputs "1" produced from coin detectors 3, 4 and 5 are applied to window circuits 202, 204 and 206, respectively, thereby operating acceptable solenoid 6 as well, as described above in the case of two true 10 yen coins being deposited.

The operation of the coin receiving apparatus in the event a false 10 yen coin is deposited in coin detection path 2 is described below.

Figure 7A:
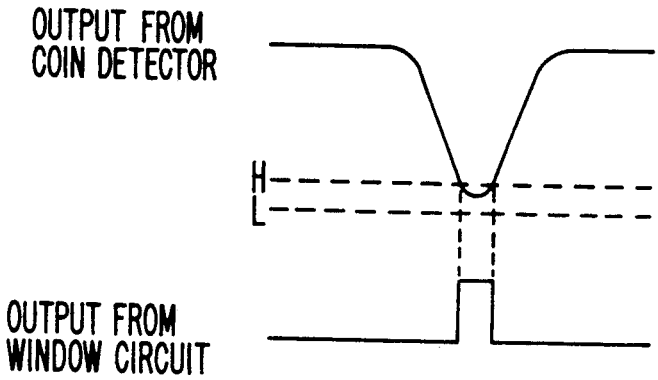
FIGS. 7(*a*), 7(*b*) and 7(*c*) are views showing waveforms of outputs of window circuits shown in FIG. 4.
Figure 7B:
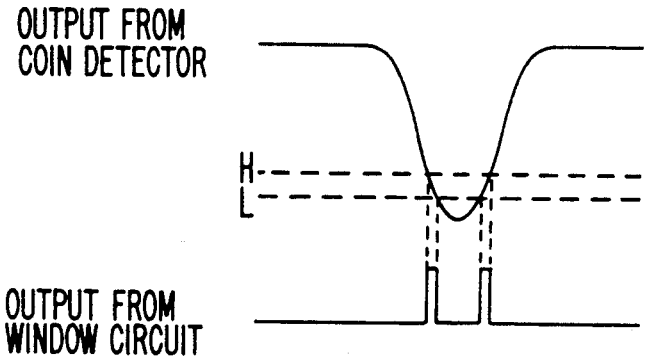
Figure 7C:
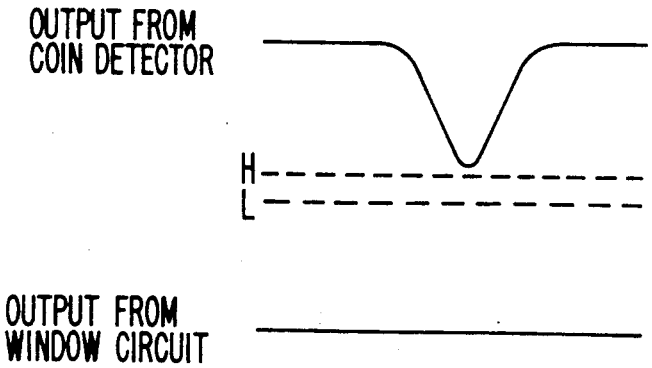

In case a false 10 yen coin is deposited in coin deposition path 2 but which is the same as a true 10 yen coin with respect to its diameter and surface incuse pattern and shape, but not its material, coin detector 3 and coin detector 5 detect the diameter and surface incuse pattern and shape of the deposited false coin, respectively, and produce outputs A and C, which are detected waveshapes having a peak value, respectively. The peak levels of the 10 yen coin detection waveshape of outputs A and C are respectively compared with upper reference voltages H 11 and H 13, and lower reference voltages L 11 and L 13 at comparators 211 and 212, and 219 and 220. Since its respective peak levels are between upper reference voltages H 11 and L 11, and lower reference voltages H 13 and L 13 as shown in FIG. 7 (a), window circuits 201 and 205 respectively apply outputs "1", i.e., G1 and G3 to one input terminals of first AND gates 231 and 235. On the other hand, coin detector 4 detects the false material of the deposited false coin, and produces output B, which is detected by a waveshape having a peak value. The peak level of the 10 yen coin detection waveshape of output B is compared with upper reference voltages H 12 and lower reference voltages L 12 at comparators 215 and 216. Since its peak level is below lower reference voltage L 12 as shown in FIG. 7 (*b*) or greater than upper reference voltage H 12 as shown in FIG. 7 (*c*), window circuit 203 applies output "1" or "0" as G2 to one input terminal of first AND gates 233. Accordingly, first AND gate 233 compares output "1" from comparators 112 with output "1" or "0" from window circuit 203, and applies output "0" to the input terminal of third pulse generators 243. Third pulse generator 243 produces output "0", i.e., I2, and applies output "0" to set terminal S of RS flip-flop 273. Thus, the output "0" produced from RS flip-flop 273 is applied to third AND gate 281, thereby acceptable solenoid 6 is not energized. The deposited false coin is returned to return path 10 via opening 9.

The operation of the coin receiving apparatus in the event a false 10 yen coin, of which the material is different, is deposited in coin detection path 2, has been described. The operation of the coin receiving apparatus in the event a false 10 yen coin, of which the diameter or surface incuse pattern and shape is different, is deposited in coin detection path 2, is similar to the operation for when the material is different. Also, when the deposited coin is a 50 yen coin, the operation of the coin receiving apparatus as shown above is similar to the operation for 10 yen coins.

In this embodiment, although the coin detectors detect the diameter, surface incuse pattern and shape and material, the coin detectors may detect other characteristics of the coins. In addition, the coin receiving apparatus according to this invention is applicable to the other sorts of coins, too.

This invention has been described in detail in connection with a preferred embodiment. This embodiment, however, is merely for example only and the invention is not restricted thereto. It will be easily understood by those skilled in the art that other variations and modifications can easily be made within the scope of this invention, as defined by the appended claims.

I claim:

1. In a coin receiving apparatus for use in a vending machine having a first coin detector for producing an output corresponding to the diameter of a deposited coin, said coin diameter detector including a coil arranged adjacent to a coin detection path so that the magnetic flux thereof is substantially perpendicular to the diameter of the deposited coin passing through the coin detection path, at least one additional coin detector of a differential transformer type sequentially arranged adjacent to said coin diameter detector in the coin detection path, each at least one additional coin detector producing an output corresponding to coin characteristics other than coin diameter, coin determination means for judging whether the deposited coin is true or false in response to the detected outputs from said respective coin detectors and providing a true or a false judgement output signal, and coin receipt control means responsive to the true or false judgment output signal of said coin determination means for controlling the receipt or return of the deposited coin, whereby the deposited coin is received in the receiving apparatus if the judgment output signal is true and is returned if the judgment output signal is false, the improvement comprising:

successive deposit determination means for outputting a successive deposit indication signal when a second deposited coin passes an initial coin detector before a first deposited coin passes a final coin detector, said initial and final coin detectors each being one of the coin detectors arranged adjacent to the coin detection path, and the first deposited coin being deposited before the second deposited coin, timer means for generating a timing pulse, the timer means starting to operate when the first deposited coin passes through said final coin detector and said successive deposit determination means outputs a successive deposit indication signal, and determination output control means coupled to the timer means for applying the judgment output signal from said coin determination means to said coin receipt control means when said timer means does not generate the timing pulse.

2. The coin receiving apparatus of claim 1 wherein the timing pulse generated by said timer means has a predetermined length of time related to the length of time a first deposited coin takes to pass from said final coin detector to an inlet of a true coin path whereby the operation of the true coin path inlet is delayed until the first coin passes the true coin path inlet.

3. In a coin receiving apparatus for a coin operated machine having a first coin detector for producing an output corresponding to the diameter of a deposited coin, said first coin detector including a coil arranged adjacent to a coin detection path such that magnetic flux generated by the coil substantially crosses the diameter of the deposited coin as it passes through the coin detection path; at least one additional coin detector of a differential transformer type sequentially arranged adjacent to said coin diameter detector means in the coin detection path for producing at least one additional output corresponding to coin characteristics other than coin diameter; coin determination means, responsive to the output of said coin detectors including said first coin detector, for determining whether the deposited coin is true or false and outputting a true or a false judgment signal based on that determination; and coin receipt control means, responsive to the true or false judgment signal output of the coin determination means, for controlling the receipt or return of the deposited coin, whereby the deposited coin is received by the receiving apparatus if the judgment signal is true and is returned if the judgment signal is false, the improvement comprising:

successive deposit determination means, responsive to an initial coin detector and a final coin detector, for determining whether a second deposited coin passes the initial coin detector before a first deposited coin passes the final coin detector, said initial and final coin detectors each being one of the coin detectors arranged adjacent to the coin detection path, and the first deposited coin being deposited before the second deposited coin, timer means, responsive to the final coin detector and the successive deposit determination means, for timing a predetermined interval of time, and determination signal control means, responsive to the successive deposit determination means, the final coin detector and the timer means, for providing the output of the coin determination means to the coin receipt control means.

4. The coin receiving apparatus of claim 3 wherein the predetermined interval of time timed by the timer means is related to the length of time required for the deposited coin to travel from the final coin detector to an inlet of a true coin path controlled by the coin receipt control means.

5. A coin receiving apparatus comprising:

first coin detector means for detecting the diameter of a deposited coin as the deposited coin passes through a coin detection path and outputting a signal corresponding to the diameter of the deposited coin;

at least one additional coin detector means for detecting coin characteristics other than coin diameter as the deposited coin passes through the coin detection path and outputting at least one additional signal corresponding to detected characteristics of the deposited coin;

coin authenticity decision means, responsive to the signal output from the first coin detector means and the at least one additional signal output from the at least one additional coin detector means, for determining whether a deposited coin is authentic and outputting an authentic coin signal if the deposited coin is determined to be authentic;

consecutive deposit determination means, responsive to the first coin detector means and the at least one additional coin detector means, for outputting a consecutive deposit signal when a first deposited coin is detected by one of the at least one additional coin detector means after a second deposited coin is detected by the first coin detector means and outputting a consecutive deposit signal;

timer means, responsive to the consecutive deposit signal, for outputting a timer signal having a predetermined length of time; and coin acceptance control means, responsive to the authentic coin signal, consecutive deposit signal and the timer signal, for controlling the acceptance or rejection of a deposited coin, whereby a deposited coin is accepted when the authentic signal is present and no consecutive deposit signal and timer signal are present, and is rejected when a consecutive deposit signal and timer signal are present.

6. The coin receiving apparatus of claim 5, wherein the at least one additional coin detector means includes at least one differential transformer.

7. The coin receiving apparatus of claim 5, wherein the consecutive deposit determination means includes counters responsive to the signals output from the first coin detector means and the at least one additional signal output from the at least one additional coin detector means.

8. The coin receiving apparatus of claim 5 further comprising a coin acceptance means, responsive to the coin acceptance control means, for accepting or rejecting a deposited coin.

9. The coin receiving apparatus of claim 5, wherein the coin authenticity decision means includes window means for comparing the output signals of the first coin detector means and the at least one coin detector means to associated upper and lower limits, the upper limit and lower limits associated with the first coin detector means corresponding to an expected output for an authentic deposited coin, and the upper limit and lower limits associated with each of the at least one additional coin detector means corresponding to an expected output for an authentic deposited coin.

10. The coin receiving apparatus of claim 5, wherein the first coin detector means is arranged along the coin detection path as the initial coin detection means the deposited coin passes and the at least one additional coin detector means to which the consecutive deposit determination means is responsive is arranged along the coin detection path as the final coin detector means the deposited coin passes.

* * * * *